US008500386B2

(12) United States Patent
Griffiths et al.

(10) Patent No.: US 8,500,386 B2
(45) Date of Patent: Aug. 6, 2013

(54) LATCHING SYSTEM FOR AUTOMATICALLY SECURING FRONT-MOUNTED LOADER MAST TO TRACTOR MOUNTING FRAME

(75) Inventors: Stephen Griffiths, Thorold (CA); Radu T. Guja, Welland (CA)

(73) Assignee: Deere & Company, Moline, IL (US)

( * ) Notice: Subject to any disclaimer, the term of this patent is extended or adjusted under 35 U.S.C. 154(b) by 671 days.

(21) Appl. No.: 12/767,209

(22) Filed: Apr. 26, 2010

(65) Prior Publication Data

US 2011/0262256 A1 Oct. 27, 2011

(51) Int. Cl.
*E02F 3/627* (2006.01)

(52) U.S. Cl.
CPC ..... *E02F 3/627* (2013.01)
USPC ..... 414/686

(58) Field of Classification Search
USPC ..... 414/680, 685, 686; 172/272–275
See application file for complete search history.

(56) References Cited

U.S. PATENT DOCUMENTS

| | | | | |
|---|---|---|---|---|
| 6,386,821 | B1 * | 5/2002 | Schneider | 414/686 |
| 7,168,907 | B2 | 1/2007 | Lyons et al. | |
| 2007/0292254 | A1 * | 12/2007 | Mailleux | 414/686 |

* cited by examiner

*Primary Examiner* — Saul Rodriguez
*Assistant Examiner* — Brendan Tighe

(57) ABSTRACT

A front-mounted loader includes a pair of loader arms each having a rear end pivotally coupled to a loader mast which, in turn, includes lower and upper cross pins respectively located in an upwardly opening and forwardly opening pin receptacles. The forwardly opening receptacle of each loader mounting frame forms a fixed part of a latch assembly defining an upper region of the mounting frame and including latch member mounted for pivoting about a horizontal axis and having a forward nose provided with a downwardly opening receptacle which engages the upper cross pin when the mast is latched to the mounting frame. An over center biasing spring is connected to each latch member and resists movement either from a latching position or an unlatching position. Each mast carries a latch member operating rod which, during detaching the mast from the associated loader mounting frame, acts to engage and move the latch member from its unlatching position, to which it has previously been manually moved, to a latching position once the upper cross pin is moved forwardly from the associated forwardly opening pin receptacle of the mounting frame.

11 Claims, 5 Drawing Sheets

X
110
114
36
108
126
106
136
116
134
104
180
118
96
112
130
102
124
132
150
120
126
138
100
122
148
144
142
124
146
90
12
140

LATCHING SYSTEM FOR AUTOMATICALLY SECURING FRONT-MOUNTED LOADER MAST TO TRACTOR MOUNTING FRAME

FIELD OF THE INVENTION

The present invention relates to front-mounted loaders, and, more particularly relates to latching systems for automatically securing a loader mast to a tractor mounting frame.

BACKGROUND OF THE INVENTION

Many current known loader latching systems require an operator to remove or to install pins to disconnect or attach the loader to the tractor and/or have latching systems that are complex and unreliable. In order to overcome these drawbacks of the prior art designs, latching systems have been designed which do not require the insertion of pins, and which have automatic latching features. One such latching system is disclosed in U.S. Pat. No. 7,168,907, dated Jan. 30, 2007, and assigned to the same assignee as is the instant application, is one of these patents.

One drawback associated with the design disclosed in this patent is that prior to mounting the loader on the tractor the operator must manually trip latches which are located on the loader mast, making it necessary for the operator to drive the tractor forwardly between the loader arms and then stop when close enough to the mast for tripping the with his/her feet and then to resume driving the tractor forwardly to a proper location for having respective receptacles at the bottom of the mast lowered onto respective bushings carried by the loader mounting frames.

It is desired then to provide a latching system which eliminates the go/stop/go operation during mounting the loader on the tractor.

SUMMARY OF THE INVENTION

According to the present invention, there is provided an improved latching system for securing a loader to a tractor.

An object of the invention is to provide a latching system which is a simple robust system, including latch hooks which automatically latch the loader to the tractor during installation and which can be manually moved to their respective open positions while the operator is seated on the tractor and prior to the tractor being driven to the detached loader.

This object is accomplished by providing each of the pair of loader mounting frames with a latch hook located at an upper region of the mounting frame, with each latch hook being joined to a lever projecting to the rear for being manipulated by a seated operator so as to trip the latch hook to an open position, with each mast and latch hook being provided with respective abutment surfaces that come into engagement with each causing the latch hook to be tripped to its closed latching position other during movement of the mast for positioning a bushing carried by the mast into a receptacle located on the mounting frame.

This and other objects of the invention will become apparent from a reading of the ensuing description together with the appended drawings.

DESCRIPTION OF THE PREFERRED EMBODIMENT

Preliminarily it is to be noted that, as used herein, the terms right and left are considered from the perspective of a person standing behind the described structure and facing in the direction of forward travel.

Figure 1:
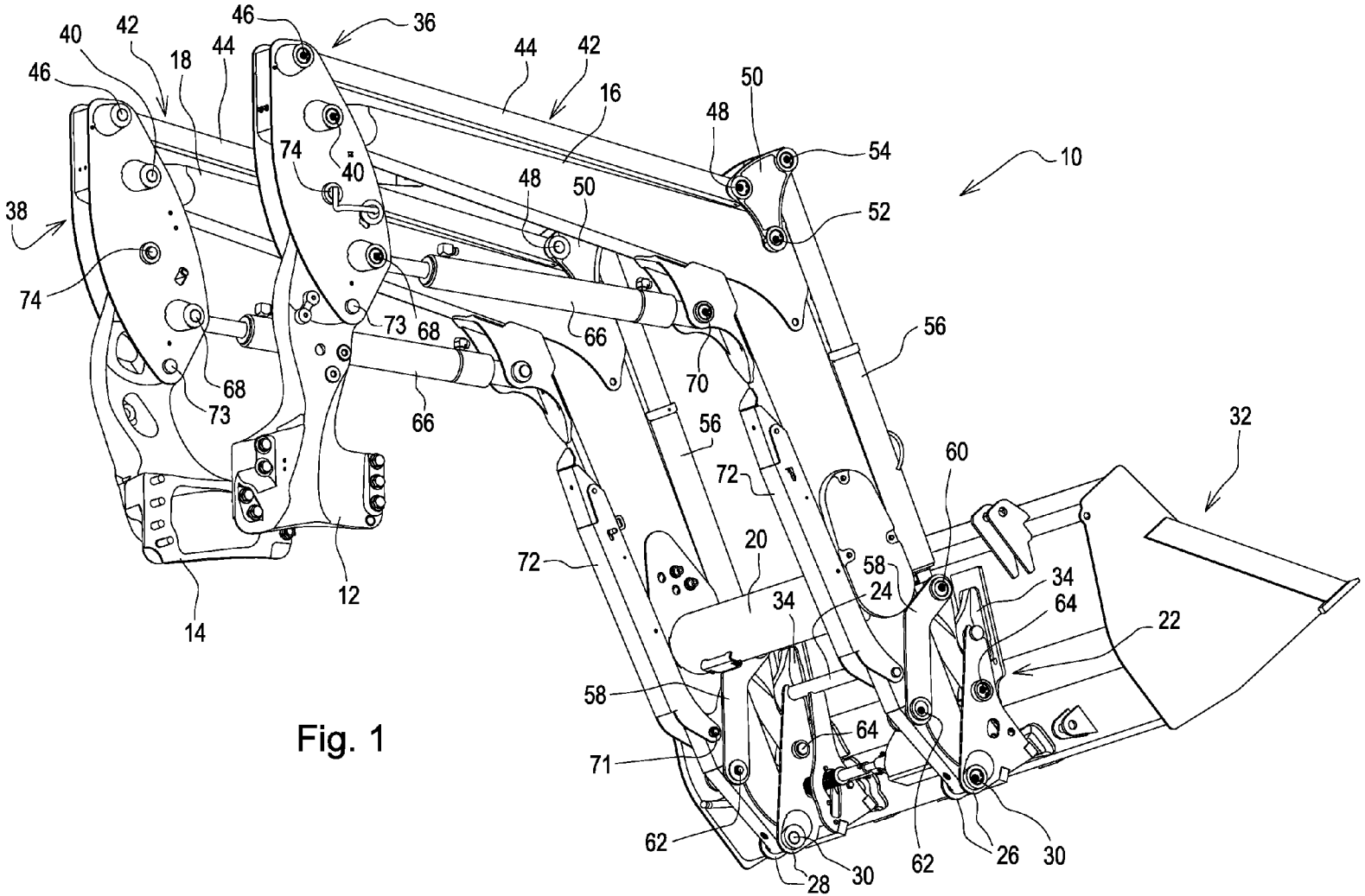
FIG. 1 is an oblique right side view of a loader and loader mounting frame arrangement embodying a latching arrangement constructed in accordance with the present invention.

Referring now to FIG. 1, there is shown a loader 10 mounted to right and left loader mounting frame structures 12 and 14, the frame structures being adapted for being mounted to opposite sides of a main frame of a work vehicle, such as a tractor (not shown). The loader includes a boom structure comprising right and left arms 16 and 18, respectively, having forward portions joined together by a cross tube 20.

An implement carrier 22 includes opposite, upright end plate assemblies having upper ends joined by a horizontal cross bar 24. The carrier plate assemblies include right and left pairs of plates 26 and 28 respectively disposed in straddling relationship to, and being pivotally mounted to, forward ends of the arms 16 and 18 by a pair of pins 30.

An implement, here shown as a bucket 32, is mounted to the carrier 22 and for that purpose includes a pair of laterally spaced hooks 34 fixed to a back wall of the bucket 32 and defining downwardly opening receptacles in which opposite end regions of the carrier cross bar 24 are respectively received. Fixed to lower back wall locations of the bucket 32 are a pair of lugs (not shown) containing holes that are aligned with holes in the plate assemblies of the carrier 22, with a latch rod arrangement (not shown) including latch rod sections projecting through the aligned holes in the lugs and plate assemblies, thereby securing the bucket 32 to the carrier 22.

Right and left, upright loader masts 36 and 38 are respectively pivotally coupled to rear ends of the loader arms 16 and 18 by a pair of pins 40. A pair of identical leveling linkages 42 are respectively associated with the loader arms 16 and 18, with each linkage 42 including a rear link 44 having a rear end pivotally coupled to a top end of a respective one of the masts 26 and 28 by a pivot pin 46, and having a front end pivotally connected by a pivot pin 48 to a rear corner of a respective one of a pair of triangular intermediate links 50 having a bottom corner pivotally connected by a pin 52 to a respective one of the arms 16 and 18. A forward corner of each of the intermediate links 50 is pivotally connected by a pin 54 to a respective rod end of a pair of extensible and retractable hydraulic cylinders 56 having their respective barrel ends pivotally connected to a pair of tilt linkages 58 by a pivot pin 60 which extends through first ends of first and second links of the tilt linkages 58, with second ends of the first links being coupled to the loader arms 16 and 18 by pivot pins 62, and with second ends of the second links being coupled to opposite ends of the carrier 22 by pivot pins 64. Thus, the hydraulic cylinders 56 serve not only as one of the links of the leveling linkages 42, but also serve as tilt cylinders for effecting tilting of the bucket 32, or any other implement, coupled to the carrier 22.

A pair of extensible and retractable hydraulic boom lift cylinders 66 are coupled one each between the right arm 16 and right mast 36, and between the left arm 18 and left mast 38. Specifically, rod ends of the cylinders 56 are pivotally connected to the masts 36 and 38 by pins 68, while barrel ends of the cylinders 56 are pivotally coupled to the arms 16 and 18 by pins 70.

Respectively pivotally mounted, as by pins 71, to lower rear regions of the loader arms 16 and 18 are elongate, channel shaped parking stands 72, here shown in nested stored positions wherein they extend upwardly along back sides of the arms 16 and 18. Fasteners (not shown) are respectively provided for releasably retaining the stands 72 in the stored positions, the stands being released so as to pivot counterclockwise about the pins 71 when moving to park positions wherein feet provided at the distal ends of the stands are brought into contact with the ground, as is well known.

The masts 36 and 38 each include lower and upper cross pins 73 and 74, respectively which are used to secure the masts the right and left loader mounting frame structures 12 and 14 in a manner described in further detail below, with only the details of the manner of securing the right mast 36 to the right mounting frame 12 being illustrated and described, with it to be understood that the left mast 38 and left loader mounting frame structure 14 are secured together in a similar manner.

Figure 2:
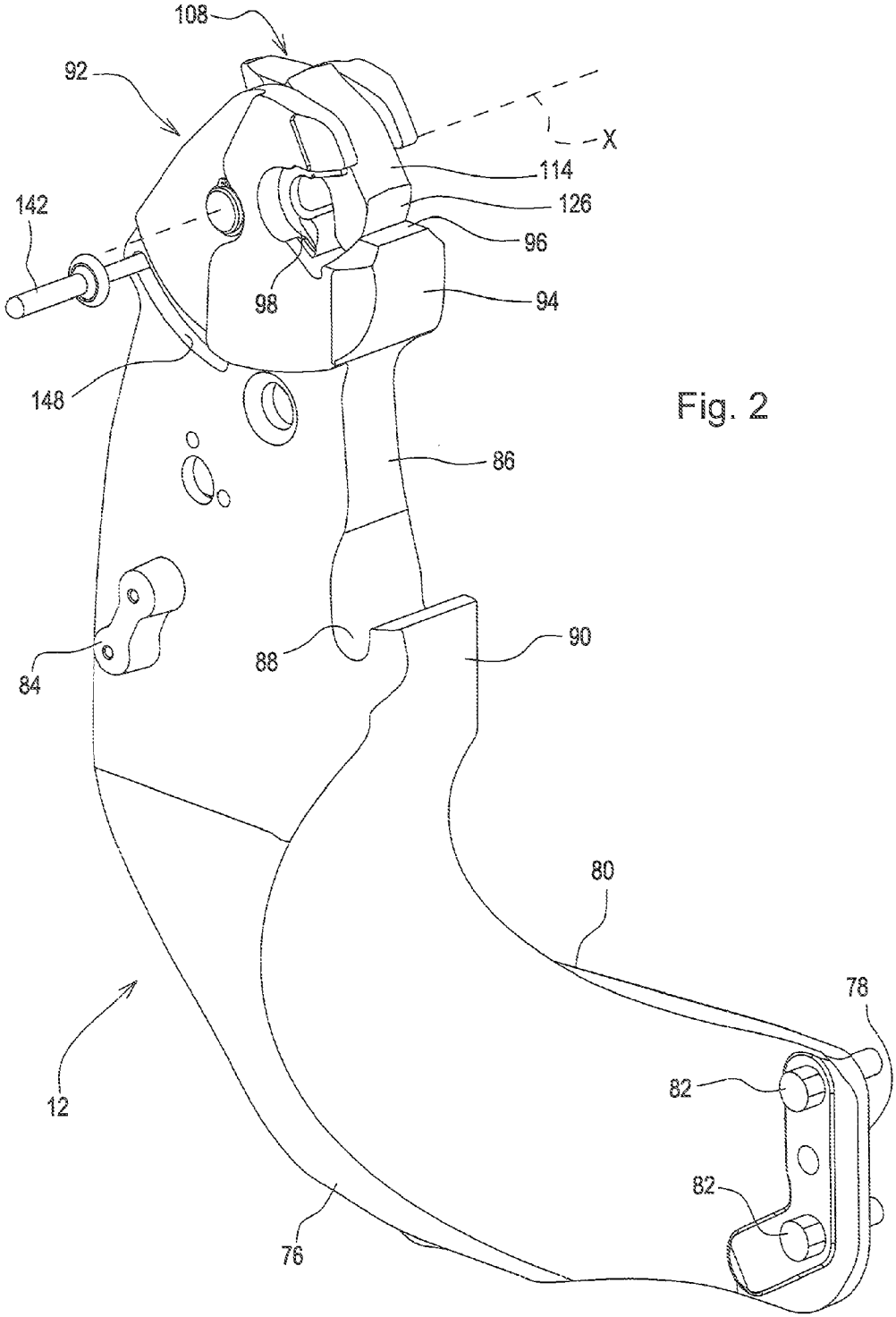
FIG. 2 is a right rear perspective view showing the right loader mast latched to the right loader mounting frame by a latch arrangement constructed in accordance with the principles of the present invention.
Figure 3:
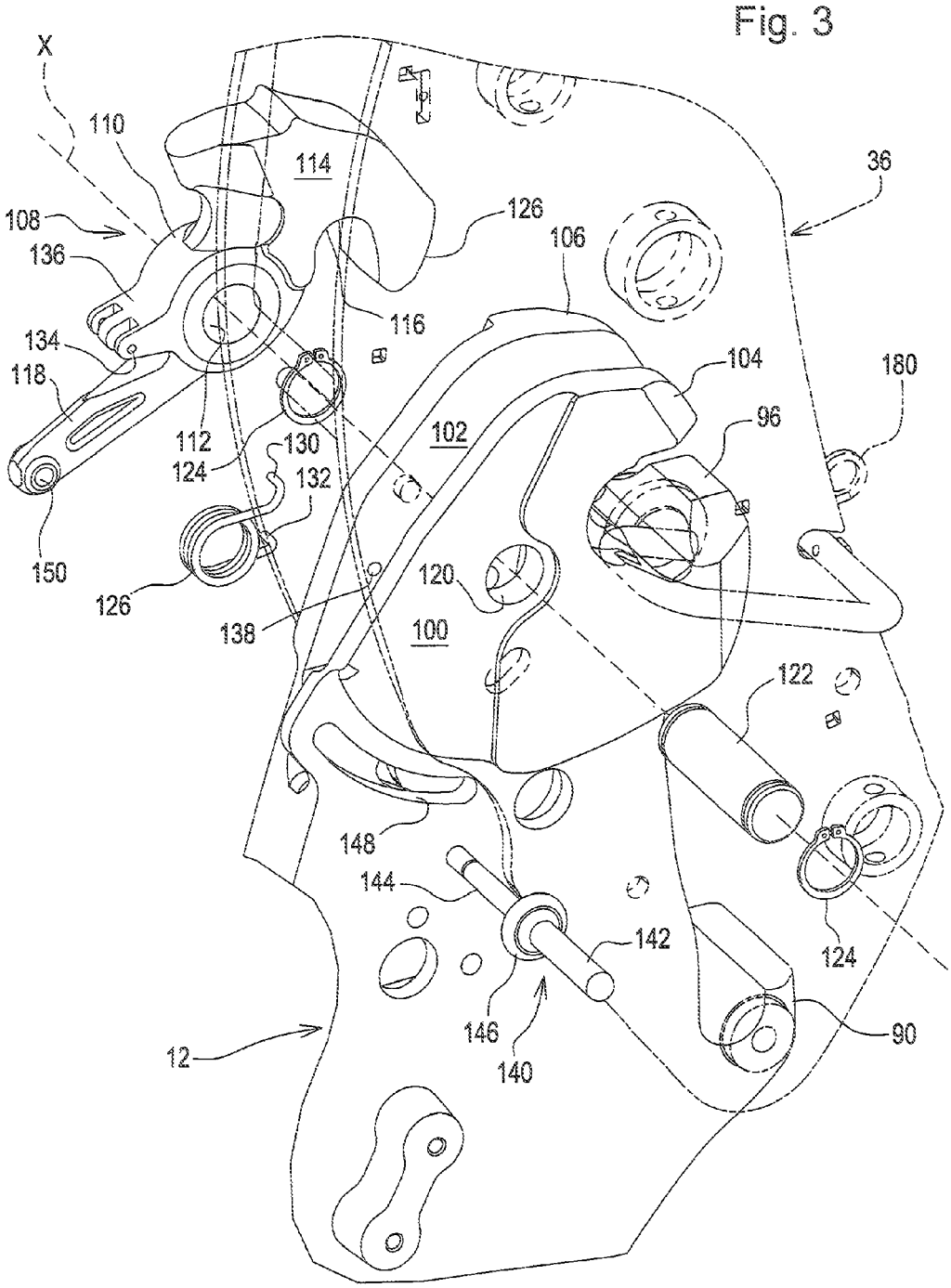
FIG. 3 is a right rear exploded view of an upper region of the loader mounting frame and showing a lower portion of the loader mast in phantom.

Referring now to FIG. 2, it can be seen that the right loader mounting frame structure 12 includes a lower mounting section 76 which curves upwardly and outwardly from inwardly facing, vertical planar mounting surfaces 78 and 80 which are adapted for being bolted to planar mounting surfaces of a tractor main frame by a plurality of bolts 82 (only two shown) which project through transverse bores provided in the mounting section 76. Joined to the mounting section 76 is an upright standard section 84 including an upright forward surface 86 having a lower end joined to an upwardly opening cross pin receptacle 88 bounded on its forward side by an upwardly projecting lower lip 90 located at a lower front region of the standard section 84. An upper end region of the upright standard section 84 defines a fixed portion of a latch assembly 92 comprising an upper lip 94 joined to, and extending forwardly and upwardly from an upper end of the front surface 86, the lip 94 having an upper surface 96 defining a lower extreme of an entrance of a forwardly opening upper cross pin receptacle 98 located in a forward central region of the fixed portion of the latch assembly 92. Referring now also to FIG. 3, it can be seen that the fixed portion of the latch assembly 92 includes a bifurcated region comprising transversely spaced right and left plate-like sections 100 and 102, respectively, including upper forward projections 104 and 106 having undersurfaces forming an upper boundary of the forwardly opening upper cross pin receptacle 98.

Figure 5:
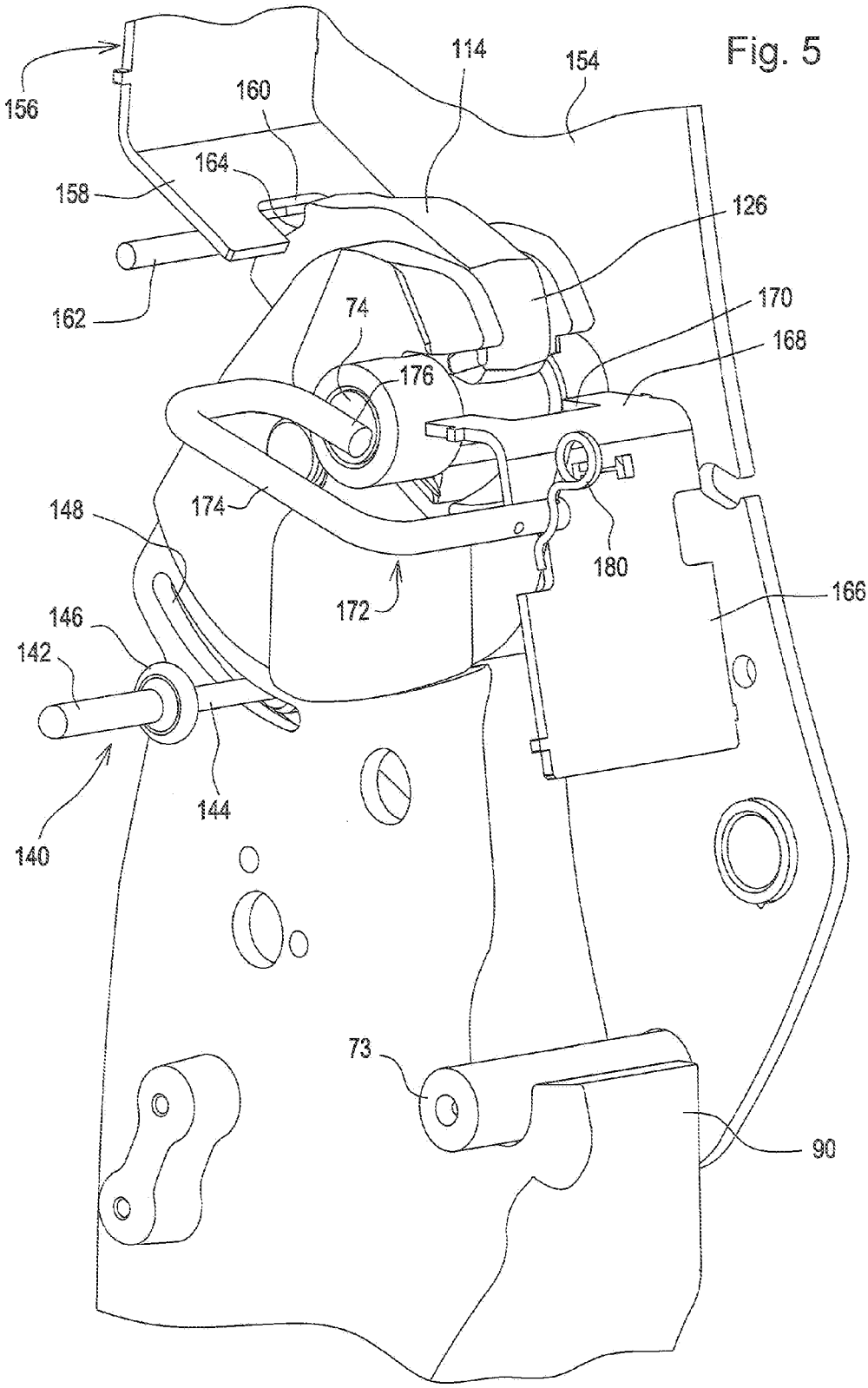
FIG. 5 is an enlarged view of a central region of the loader mounting frame and mast shown in FIG. 4, but with the right mast side plate being removed for revealing the latch assembly structure and showing the latch member in an unlatching position.

The latch assembly 92 includes a movable portion defined by a latch member 108 comprising a central cylindrical body 110 containing a cross bore 112 and having a forward region joined to a forwardly projecting nose 114 defining a downwardly opening upper cross pin receptacle 116, and having a lower rear region joined to a rearwardly projecting lever 118. The latch member 108 is received between the plate-like sections 100 and 102, with the cross bore 112 being in axial alignment with respective bores provided in the plate-like sections (only bore 120 in section 100 is visible). A pin 122 is received in the aligned bores 118 and 112 and is axially fixed by a pair of snap rings 124 respectively located in snap ring grooves provided in opposite end regions of the pin 122 respectively adjacent outer faces of the plate-like sections 100 and 102. The pin 122 thus establishes a horizontal transverse axis X about which the latch member 108 may be selectively pivoted between a latching position, as shown in FIG. 2, wherein the nose 114 is lowered so that the receptacle 116 is positioned for embracing the upper cross pin 74 of the right mast 12, with a curved forward surface 126 of the nose then engaging a rear surface of the lip 94, and an unlatching position, as shown in FIG. 5, wherein the nose 114 is elevated sufficiently to permit the cross pin 74 to pass forwardly from the receptacle 98. A coil torsion spring 128 is provided for selectively biasing the latch member either to its latching position or to its unlatching position. This is accomplished by mounting the spring 128 such as to create a spreading force between upper and lower, leftwardly out-turned ends 130 and 132, respectively, with the upper out-turned end 130 being received in a cross bore 134 of a clevis 136 joined to, and projecting to the rear from, a rear region of the central body 110 of the latch member 108 and with the lower out-turned end 132 being received in a bore 138 provided in the left plate-like section 102 of the latch assembly 92. The locations of the spring ends 132 and 134 are so located relative to each other and to the pivot axis X of the latch member 108 that the line of action of the spring 128 moves over center relative to the axis X when the latch member 108 is moved between its latching and unlatching positions. Specifically, the line of action of the spring 128 is above the axis X when the latch member 108 is in its latching position, and is below the axis X when the latch member is in its unlatching position.

The lever 118 is provided to aid an operator in manually pivoting the latch member 108 against the action of the spring 128 from its latching to its unlatching position. Since the lever 118 cannot be easily accessed by an operator, a transverse handle 140 in the form of cylindrical outer and inner rod sections 142 and 144, respectively, joined to each other at a cylindrical hand guard 146, with the inner rod section 144 having a diameter smaller than that of the outer section and projecting inwardly from the guard 146 through an arcuate slot 148 formed in the plate-like section 100 at a radius about the pivot axis X. An inner end region of the rod section 144 is received in a cross bore 150 provided at a rear end of the lever 118. The inner rod section 144 occupies an upper end of the slot 148 when the latch member 108 is in its latching position. As explained in further detail below, when it is desired that the loader 10 be detached from the mounting frame 12, an operator will grasp the outer rod section 142 of the handle 140 and move the handle forwardly in the slot 148, thereby causing the latch member 108 to pivot counterclockwise about the axis X as it moves towards its unlatching position. Initially this movement of the latch member 108 is resisted by the torsion spring 128, but at some point the line of action of the spring 128 moves over center relative to the pivot axis X so that it biases the latch member 108 to its unlatching position.

Figure 4:
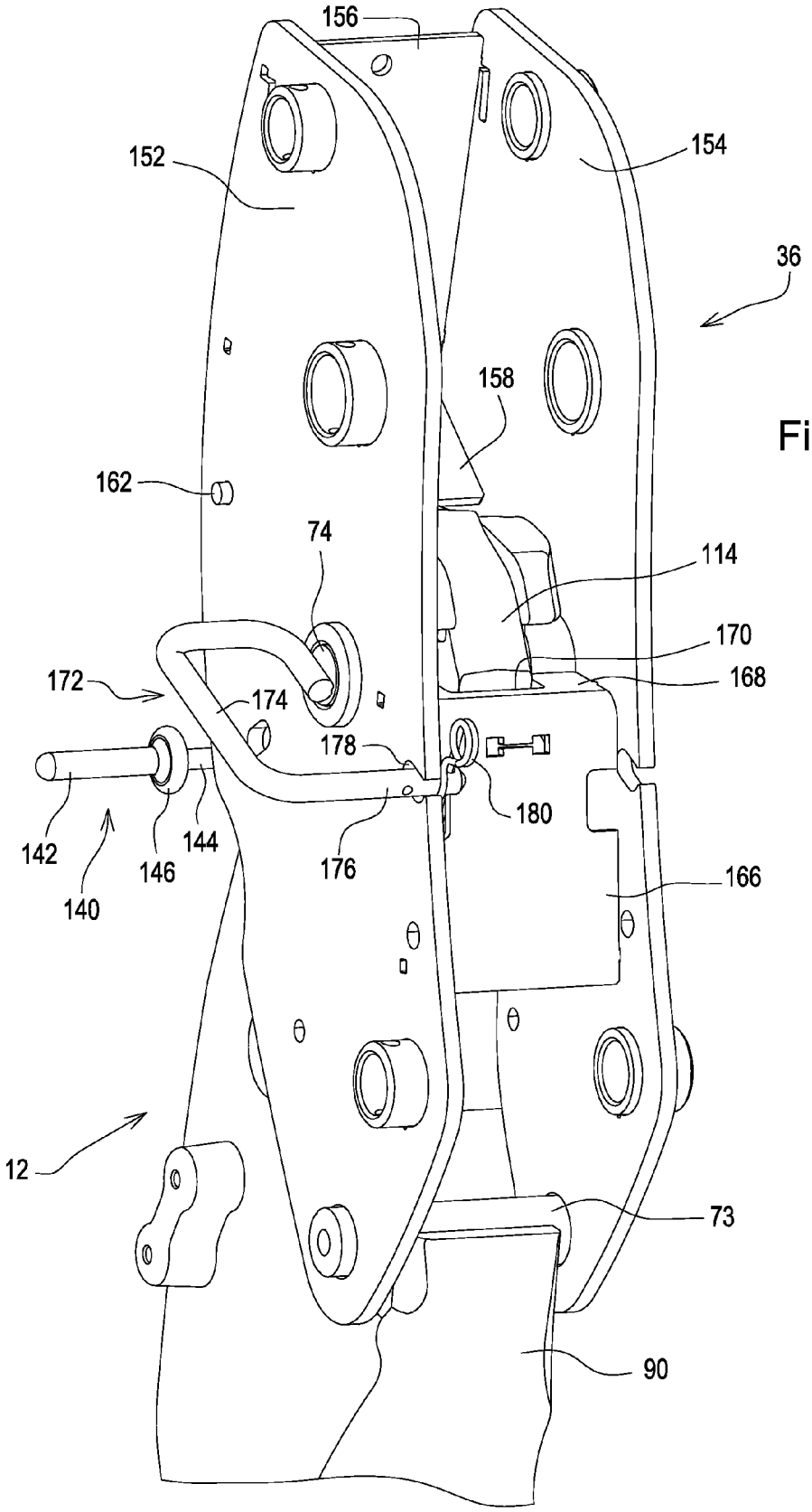
FIG. 4 is a right front oblique view showing an upper region of the loader mounting frame and the right loader mast, with the latch member shown in its latching position.

Referring now to FIGS. 4 and 5, it can be seen that the mast 36 includes right and left parallel side plates 152 and 154 having upper rear regions joined by an upright leg of an L-shaped plate 156 having a fore-and-aft extending leg 158 projecting forwardly from the upright leg at a location chosen such that, when the mast 36 is coupled to the mounting frame 12, a forward edge of the leg terminates adjacent an upper rear region of the latch assembly 92 and contains a clearance notch 160 into which receives the latch member 108 when pivoting towards the unlatching position. Spaced a short distance below the leg 158 is a horizontal latch member operating rod 162 having opposite ends received in the side plates 152 and 154, the operating rod 162 being located so that it will engage a rear abutment surface 164 of the latch member 108 and move the latch member to its latching position, when the mast 36 is rocked forwardly relative to the latch assembly 92 during a detaching operation, with the latch member 108 in its unlatching position, as shown in FIG. 5. Provided for joining a central forward region of the mast side plates 152 and 154 together is an inverted L-shaped plate 166 having a fore-and-aft extending leg 168 projecting towards a center of the upper cross pin 74 and including a rear edge terminating adjacent the upper cross pin 74 and provided with a notch 170, which receives the latch member nose 114 when the latch member 108 is in its latching position, shown in FIG. 4. The lower cross pin 73 joins a lower region of the plates 152 and 154 and is received in the complimentary shaped, upwardly opening receptacle 88 provided in an upper surface of a forwardly projecting mounting lug 86 of the right loader mounting frame 12 when the mast 36 is mounted to the mounting frame, as shown in FIG. 4.

It is noted that the upper cross pin 74 is mounted for being removed and, for that purpose, a formed rod handle 172 has a horizontal inner end fixed to a right end of the pin 74 and being joined to a hand grip section 174 spaced outwardly from, extending parallel relative to, the side plate 152, the forward end of the section 174 being joined to a horizontal, transverse end section 176 that is received in a notch 178 provided in a front edge of the plate 152 and secured from moving outwardly from the plate 152 by a cotter pin 180, thereby securing the cross pin 74 in place.

In operation, assuming that the loader 10 is mounted to the loader mounting frames 12 and 14, which are carried by a tractor (not shown), the loader may be detached from the frames 12 and 14 by carrying out the following steps, noting that while some of the structure described is illustrated with reference only to the right mast 36 and right loader mounting frame 12, it is to be understood that an identical structure is associated with the left mast 38 and left loader mounting frame 14:

(a) driving the tractor to a desired location having a loader parking surface;

(b) operating the control valve associated with the lift cylinders 66 to cause them to retract and place the bucket 32 on the parking surface, then effecting extension of the tilt cylinders 56 to roll the bucket 32 forwardly about the pivot pins 30 until a forward edge of the bucket exerts a downward pressure on the parking surface;

(c) moving the latch members 108 to their respective unlatching positions (unlatching position for right latch member 108 being shown in FIG. 5) by grasping the latch member handle 142 of each latch member and moving it forwardly in the slot 148 until the action of the biasing spring 126 moves over center so as to retain the latch member 108 in its unlatching position;

(d) releasing the parking stands 72 from their stored positions and pivoting them downwardly about the pins 71 to respective park positions wherein feet at the distal ends of the stands are engaged with the parking surface;

(e) placing the tractor in neutral and operating the controls for effecting extension of the lift cylinders 66, thereby causing the masts 36 and 38 to pivot counterclockwise about the lower cross pins 73, with the latch member operating rod 162 of each mast engaging the surface 160 at the backside of the latch member nose 114 of the adjacent latch member 108, thereby effecting clockwise pivoting of the latch member until the action of the associated biasing spring 126 moves back over center such that it once again biases the latch member to its latched position;

(f) effecting retraction of the tilt cylinders 56 so as to cause the bucket 32 to roll back about the pivot pins 30 thereby causing the loader arms 16 and 18 to pivot clockwise about the contact point of the parking stands 72 with the parking surface and in the masts 36 and 38 being lifted upwardly a distance sufficient for the lower cross pins 73 to be lifted out of the mounting frame receptacles 88; and (g) disconnecting the tractor hydraulic system from the loader hydraulic system;

The following steps are followed when attaching the parked loader 10 to a tractor equipped with the loader mounting frames 12 and 14:

(a) driving the tractor straight between the opposite arms 16 and 18 of the loader 10, while aligning the masts 36 and 38, respectively, with the mounting frames 12 and 14;

(b) connecting the tractor hydraulic system to the loader hydraulic system;

(c) effecting extension of the tilt cylinders 56 so as to roll the bucket 32 forwardly about the pins 30, thereby lowering the masts 36 and 38 so as to place the lower cross pins in the receptacles 88 of the mounting frames 12 and 14;

(d) placing the tractor in neutral and extending the lift cylinders 66 until the upper cross pins 74 of the masts 36 and 38 respectively engage the curved front surfaces 126 of the latch member noses 114, causing the latch members 110 to pivot counterclockwise about the horizontal axis X, against the action of the respective springs 126, a sufficient distance for permitting the upper cross pins 74 to move rearwardly in the forwardly opening pin receptacles 98 of the mounting frames 12 and 14 and into the latch receptacles 116 of the latch members 108, with the springs 126 then returning the latch members 108 to their latching positions; and (e) extending the tilt cylinders 56 for causing the bucket 32 to roll forwardly onto the forward edge of the bucket, thereby removing weight from the parking stands;

(f) pivoting the parking stands 72 from their parked positions to their stored positions and securing them to the loader arms 16 and 18.

Thus, it will be appreciated that, once manually opened for the purpose of detaching the loader 10 from the mounting frames 12 and 14, the latch members 108 are automatically moved to their latching positions during the detaching operation and that, when reattaching the loader to the mounting frames, the latch members 108 automatically move over the upper cross pin of the loader mast during the attaching operation. Further, it is to be noted that since the upper cross pins 74 can be removed from the masts 36 and 38, it is possible to mount the loader 10 to tractors provided with tractor mounting frames that do not have latch assemblies 92, but rather are provided with bores that must be aligned with the bore arrangement provided in the masts for allowing the pins 74 to be inserted through them.

Having described the preferred embodiment, it will become apparent that various modifications can be made without departing from the scope of the invention as defined in the accompanying claims.

The invention claimed is:

1. A combination including an upright loader mounting frame and an upright loader mast detachably secured together by a latching assembly, comprising: said mounting frame including a forwardly opening receptacle at an upper region thereof and an upwardly opening receptacle spaced vertically below said upper receptacle; said mast including a lower cross pin located at a lower region of the mast and being received in said upwardly opening receptacle, and including an upper cross pin located in said forwardly opening receptacle; said latching assembly including a latch member having a forward end defining a downwardly opening receptacle, with the latch member being mounted to said mounting frame for pivoting about a horizontal axis between a lowered latching position, wherein said downwardly opening receptacle is engaged with said upper cross pin, and a raised unlatching position, wherein said downwardly opening receptacle is elevated above said upper cross pin; and an over-center biasing spring arrangement being coupled to said latch member for selectively retaining said latch member is said latching and unlatching positions, thereby permitting forward movement of said upper cross pin relative to said forwardly opening receptacle.

2. The combination, as defined in claim 1, wherein said upper region of said loader mounting frame includes transversely spaced, frame side plates; and said latch member being received between said frame side plates.

3. The combination, as defined in claim 1, wherein said mast includes transversely spaced mast side plates; and said upper region of said mounting frame being received between said mast side plates.

4. The combination, as defined in claim 3, wherein said upper region of said loader mounting frame includes transversely spaced frame side plates; and said latch member being received between said frame side plates.

5. The combination, as defined in claim 1, wherein said forwardly opening receptacle has a lower forward region bounded by an upwardly projecting lip, and wherein said latch member includes a forward nose portion projecting downwardly and defining a front of said downwardly opening receptacle of said latch member and having a front surface engaged with a rear surface of said upwardly projecting lip when said latch member is in said latching position.

6. The combination, as defined in claim 5, wherein said front surface extends above said upwardly projecting lip and is located relative to said horizontal axis and so shaped that, when contacted by said upper cross pin moving into said forwardly opening receptacle during attaching of said mast to said loader mounting frame, said latch member pivots upwardly and over said upper cross pin.

7. The combination, as defined in claim 1, wherein said latch member includes a lever which extends rearward of said horizontal axis and is operable, when pressed downwardly, for pivoting said latch member from said latching position to said unlatching position.

8. The combination, as defined in claim 7, wherein a handle is joined to, and projects laterally outwardly from, a rear end of said lever so as to be positioned for being grasped by an operator seated on a tractor carrying the mounting frame.

9. The combination, as defined in claim 8, wherein said handle is defined by a rod and said mounting frame being provided with a slot receiving said handle and being formed at a radius about said horizontal axis.

10. The combination, as defined in claim 1, wherein said mast is provided with a mast contact surface located closely behind a latch member contact surface located above said pivot axis so that forward movement of said mast relative to said mounting frame, when said latch member is in said unlatching position, will result in said mast contact surface engaging said latch member contact surface so as to cause said latch member to pivot from its unlatching to its latching position.

11. The combination, as defined in claim 10, wherein said mast comprises laterally spaced mast side plates; and said mast contact surface comprises a horizontal rod having opposite ends respectively coupled to said mast side plates.

* * * * *